US011549291B2

(12) United States Patent
Srnoyachki et al.

(10) Patent No.: US 11,549,291 B2
(45) Date of Patent: Jan. 10, 2023

(54) AUXILIARY DOOR BRACE APPARATUS

(71) Applicant: S9 Engineering Technology Corp., Dayton, OH (US)

(72) Inventors: Matthew Srnoyachki, Dayton, OH (US); Jason Sopko, Dayton, OH (US)

( * ) Notice: Subject to any disclaimer, the term of this patent is extended or adjusted under 35 U.S.C. 154(b) by 38 days.

(21) Appl. No.: 15/931,584

(22) Filed: May 14, 2020

(65) Prior Publication Data

US 2020/0362607 A1 Nov. 19, 2020

Related U.S. Application Data

(60) Provisional application No. 62/848,529, filed on May 15, 2019.

(51) Int. Cl.
*E05C 19/00* (2006.01)

(52) U.S. Cl.
CPC ..... *E05C 19/005* (2013.01); *E05Y 2201/47* (2013.01); *E05Y 2201/626* (2013.01); *E05Y 2201/68* (2013.01); *E05Y 2600/626* (2013.01)

(58) Field of Classification Search
CPC .... E05C 19/005; E05C 19/003; E05C 19/007; E05C 19/18; E05C 19/182; E05C 19/188; E05C 17/00; E05C 17/02; E05C 17/04; E05C 17/045; E05C 17/047; E05C 17/12; E05C 17/16; E05C 17/166; E05C 17/18; E05C 17/20; E05C 17/22; E05C 17/44; E05C 17/446; E05C 17/46; E05C 17/48; E05Y 2201/47; E05Y 2201/68; E05Y 2600/626; Y10S 292/15; Y10S 292/65; Y10T 70/40; Y10T 70/5164; Y10T 292/34; Y10T 292/37; Y10T 292/373; Y10T 292/379; Y10T 292/391; Y10T 292/394; Y10T 292/397; Y10T 292/65; Y10T 292/67; Y10T 292/20; Y10T 292/225; Y10T 292/228; Y10T 292/288; Y10T 292/293; Y10T 292/296; Y10T 292/305
USPC ..... 292/259, 289, 290, 297, 305, 338, 339
See application file for complete search history.

(56) References Cited

U.S. PATENT DOCUMENTS 359,815 A 3/1887 Sargent
553,496 A * 1/1896 Caminetti ..... E05C 19/182 292/295
605,809 A 6/1898 Plimpton
(Continued)

FOREIGN PATENT DOCUMENTS

KR 20050037141 A * 4/2005

OTHER PUBLICATIONS http://doorbearacade.com/image-gallery, accessed Apr. 4, 2016.
(Continued)

*Primary Examiner* — Kristina R Fulton
*Assistant Examiner* — Tal Saif
(74) *Attorney, Agent, or Firm* — Benrishi Enterprises, LLC; Jason Sopko

(57) ABSTRACT

A door barricade apparatus includes a body portion having a pushing face, a port, an advancing interface, and a release interface. The apparatus further includes a shaft portion having a shaft and a door bracket. The door bracket has a throat terminating in at least an l-shaped configuration. The door bracket is pivotably coupled to the shaft at a first end and the shaft is disposed within the port.

8 Claims, 5 Drawing Sheets

(56) References Cited

U.S. PATENT DOCUMENTS 665,058 A * 1/1901 Buckley ..... E05C 19/182 292/294
672,473 A 4/1901 Brooks
1,057,277 A 3/1913 Rogers
1,073,238 A 9/1913 Huston
1,477,731 A 12/1923 Ulrich
1,544,480 A * 6/1925 Racine ..... E05C 19/182 292/296
1,888,425 A 11/1932 Dowling
2,288,022 A 6/1942 O'Brien et al.
2,562,301 A 7/1951 Dorion
3,181,319 A * 5/1965 Hudon ..... E05C 19/182 292/289
3,429,151 A 1/1969 Weingart
3,423,968 A 7/1969 Foote
3,589,761 A 6/1971 Lambert
3,671,067 A 6/1972 Wegner et al.
3,854,764 A 12/1974 Corrigan
3,894,648 A * 7/1975 Croullebois ..... B65D 7/24 441/32
3,913,962 A 10/1975 Briggs
4,022,503 A 5/1977 Bey
4,059,299 A * 11/1977 Huntley ..... E05C 19/182 116/8
4,082,335 A 4/1978 Smith
4,169,619 A 10/1979 McCraken
4,198,088 A 4/1980 Tochihara
4,200,317 A 4/1980 Polselli et al.
4,285,535 A 8/1981 Leary
4,290,635 A 9/1981 McKenzie
4,330,146 A 5/1982 Sessions, Jr.
4,387,919 A 1/1983 Quaintance et al.
4,399,672 A * 8/1983 Moorhouse ..... E05C 19/18 292/296
4,406,488 A 9/1983 Polselli et al.
4,429,913 A 2/1984 Bey
4,653,786 A 3/1987 Bopst, III
4,878,701 A 11/1989 Rondel et al.
4,958,868 A 9/1990 Watrous, Jr.
5,098,142 A 3/1992 Fontenot
5,135,272 A 9/1992 Centofante
5,193,867 A 3/1993 Husted
5,203,187 A 4/1993 Kane
5,221,116 A 6/1993 Lan
5,222,420 A 6/1993 Sorensen et al.
5,265,922 A 11/1993 Falcone
5,325,685 A 1/1994 Frank
5,297,829 A 3/1994 Richardson
5,360,245 A 11/1994 David et al.
5,443,246 A 8/1995 Peterson
5,462,321 A 10/1995 Osborn
5,531,491 A 7/1996 Skelton
5,547,236 A * 8/1996 Gregory ..... E05C 19/182 292/288
5,566,993 A 10/1996 Olivas
D376,747 S 12/1996 Jackson
5,664,814 A 9/1997 Lin
5,667,262 A 9/1997 Planchon
5,685,580 A 11/1997 West et al.
5,794,871 A 9/1998 Willetts
5,810,404 A 9/1998 Horne et al.
5,853,168 A 12/1998 Drake
5,924,751 A 7/1999 More
5,984,387 A * 11/1999 Zeller ..... E05C 19/182 292/296
6,409,236 B1 6/2002 Steele
6,416,089 B1 7/2002 Williams, Jr.
6,604,764 B2 * 8/2003 Zemzik ..... E05C 19/188 292/288
6,658,906 B1 12/2003 Wright
6,926,316 B2 9/2005 Patire et al.
6,976,716 B2 12/2005 Lin
7,216,902 B2 5/2007 Marra et al.
7,322,571 B2 1/2008 Springer
7,360,809 B1 4/2008 Poston
7,419,197 B1 9/2008 Leith
7,641,183 B2 1/2010 Fuller et al.
8,469,410 B2 6/2013 Wood
8,510,994 B2 * 8/2013 Scott ..... E05C 3/048 292/297
2006/0131802 A1 6/2006 Fuller et al.
2010/0026017 A1 2/2010 Ramos III
2011/0175374 A1 * 7/2011 Hertrich ..... E05B 65/0014 292/195
2012/0019011 A1 * 1/2012 Laborde ..... E05C 19/18 292/1
2012/0279538 A1 * 11/2012 Chen ..... E05C 19/18 292/289
2015/0292237 A1 10/2015 Nadeau
2017/0204641 A1 * 7/2017 Maher ..... E05C 17/30

OTHER PUBLICATIONS http://www.bilco.com/foundalions/slore/slorepage.asp?page=products, accessed Apr. 4, 2016.
http://www.door-jammer.com, accessed Apr. 4, 2016.
http://www.wedgeil.com/specifications.html, accessed Apr. 4, 2016.
http://www.addalock.com/shop/add-a-lock, accessed Apr. 4, 2016.
http://howsarlock.com/howsar_lock_features.php, accessed Apr. 4, 2016.
http://www.amazon.com/Secure-Portable-Door-Safety-Lock/dp/B001 IZ7RU2, accessed Apr. 4, 2016.
http://www.amazon.com/Brainerd-Portable-Door-Lock-Personal/dp/BOOOI1CKGI, accessed Apr. 4, 2016.
https://www.harborfreight.com/hand-tools/clamps-vises/bar-clamps/heavy-duty-ratchet-bar-clamp-spreader-95027.html, accessed May 13, 2020.

* cited by examiner

AUXILIARY DOOR BRACE APPARATUS

Pursuant to 37 C.F.R. § 1.78(a)(4), this application claims the benefit of and priority to prior filed co-pending Provisional Application Ser. No. 62/848,529, filed 15 May 2020, which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates generally to physical security products and, more particularly, to apparatus and methods for augmenting the forcible entry resistance of residential and commercial man-doors.

BACKGROUND OF THE INVENTION

Many facilities are configured with interior rooms, closets, passageways, and the like, that were not designed to serve as an impediment to reasonably dedicated forced entry. While there are instances where it is desirable to expediently secure areas not usually intended for shelter, hardware and infrastructure configurations may render attempts difficult or impossible.

At one extreme, passage function locksets are installed in certain areas of such facilities. A passage locket may be defined as a cylindrical or mortise locksets wherein neither the interior, nor exterior, knob or lever is capable of being locked against rotation (nor otherwise mechanically disengaged from the latch as is possible with lost-motion, or free-wheeling, type of vandal resistant door hardware). Passage lockets, while readily available in robust and heavy-duty Grade 1 cylindrical or mortise configurations, are often installed in locations that building designers deem security or privacy to be superfluous. They are also suitable for securing fire-rated fenestrations that must remain unlocked at all times, yet must also latch closed to compartmentalize a fire. Passage locksets are generally less expensive, but avoidance of nuisance locking events may also influence one's decision to use passages sets. Passage sets may be found on closet doors, doors leading from upper floors to stairwells, doors located in a cluster beyond a common locked entryway, and the like.

In areas where the prevention of unintentional entry by a well-intentioned individual is important, a privacy function lockset may be used. A privacy function lockset may be defined as a lockset wherein the exterior knob or lever may be locked against rotation by way of a thumb turn, push-button, or similar non-keyed action by a user standing on the interior side. In most instances, the exterior privacy knob or lever does not employ a keyed cylinder as a means for unlocking the lockset (say, if a patient becomes incapacitated while in a bathroom). Rather, a manufacturer-provided tool (e.g., a polygonal rod, an implement analogous to a small blade screwdriver, etc.), or a feature capable of being interfaced with a household item (e.g. a slot that may be twisted with a coin), may be used to unlock the door. As such, only someone who desires to honor the wishes of the occupant's privacy is dissuaded from opening the door. "Defeat" of the privacy function lock is trivial for an individual who wishes to enter the locked door.

Facilities may also employ keyed lockets in multiple configurations. However, even though keyed, the function or construction of the lockset may not contemplate delaying a determined forced entry attempt. For example, the lockset on a CEO's door may be keyed differently from other employee's doors, but may be no more resistant to forced entry (by kicking, wedging, prying, etc.) than the privacy function locksets used in the same facility. Additionally, most locksets are not designed with a feature that will repel a nefarious possessor of the correct key. For example, the CEO may leave his keys on a secretary's desk, while simultaneously desiring to lock himself in his office during a workplace violence event. Most mechanisms are not configured to provide continued protection if the assailant finds the CEO's keys. Similarly, in some buildings, electronic key card access causes many doors to be "locked" to general access, but may be unlocked with an electronic key card possessed by employees or staff.

As a result of these limitations, several ingress denial, or ingress delay, apparatus and methods have been devised to combat the threat of active shooters, workplace violence, or other forced entry into an occupied room. Barricading during these events with furniture, desks, bookshelves, etc. is recommended (for example, by the U.S. Department of Homeland Security) but takes time, effort, and may not be possible or effective. For example, an individual of slight build, or a child, may be unable to position massive furniture components for use as a barricade. Additionally, an out-swinging door is less conducive to barricading with furniture, since the door swings free of the impeding furniture mass. It should be noted that outward swinging doors are most frequently found in high occupancy rooms, to include classrooms, commercial storefronts, arenas, conference rooms, and the like.

Likewise, replacement locksets having dedicated lockout features do exist, but upgrading facility locks is often cost-prohibitive. For example, to replace a single classroom function lockset with an "intruder function" lockset may cost $500 to $700 in the case of a grade 1 mortise lockset.

Similarly, auxiliary devices exist that are configured to bolster the security of existing door and lockset combinations, however, most are not designed for rapid deployment under the stress of a life-threatening encounter. For example, devices marketed to augment hotel locks and disable entry by a maid or emergency key, require a multi-step locking process, and may be multi-part assemblies. Additionally, many have infirmities from a user interface perspective (they are cumbersome to use and the user's fingers/hands/arms can get in the way of the door shutting). In a vein related to the user interface, many devices require modifications to the door, necessitate power tools for installation prior to an emergency, or may be easily relocated to another door that requires barricading. Further still, many products are not strong enough to stop a concerted effort to breach the door. Lastly, of the commercially available products that address some of those issues, their design may impair removal and egress in the event of an emergency or intervening circumstances.

As a result, there exists a need in the art for a portable, rapidly deployable, emergency door barricade that is sufficiently resistant to forced entry and is designed to facilitate efficient removal thereof.

SUMMARY OF THE INVENTION

The present invention overcomes the foregoing problems and other shortcomings, drawbacks, and challenges of augmenting the forcible entry resistance of man-doors. While the invention will be described in connection with certain embodiments, it will be understood that the invention is not limited to these embodiments. On the contrary, this invention includes all alternatives, modifications, and equivalents as may be included within the spirit and scope of the present invention.

According to one embodiment of the present invention, a door barricade apparatus is provided. The apparatus includes, a housing having a pushing face, a port, an advancing interface, and a release interface. The apparatus further includes a shaft portion having a shaft and a door bracket. The door bracket has a throat terminating in at least an l-shaped configuration. The door bracket is pivotably coupled to the shaft at a first end and the shaft is disposed within the port.

According to another embodiment of the present invention, a door barricade apparatus is provide. The apparatus includes a housing having a pushing face configured to contact a frame of a door or a wall proximate the door. The apparatus further includes a port, an advancing interface, and a release interface. A shaft portion includes a shaft and a door bracket configured to mate with the edge of a door. The door bracket has a throat terminating in at least an l-shaped configuration. The door bracket is pivotably coupled to the shaft at a first end, the shaft is disposed within the port. The shaft terminates at a second end. The housing is configured to allow the second end to be displaced in a first direction toward the housing and to prohibit the second end from being displaced in a second direction away from the housing in a default condition. The housing is configured to allow the second end to be displaced in the first direction or the second direction in a released configuration. Activating the advancing interface displaces the second end in the first direction, and activating the release interface activates the released configuration.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

For the sake of clarity in the discussion that follows, the terms "secure side" or "attack side" may be equated with "exterior" and "occupant side" or "occupied side" shall be equated with "interior." An outswinging door or outswing door shall connote a configuration wherein the door swings away from a user standing on the occupant side. This is in contrast to an inswing door or inswinging door, wherein the door is configured to swing toward, or into the room of, the occupant aide. The discussion that follows will be made in reference to commercial or residential man-doors (man-doors being primarily concerned with selectively restricting or permitting the passage of pedestrian traffic). However, as will be understood by one of ordinary skill in the art, the mechanical features and methods of operation disclosed and claimed herein may be readily adapted for use with other fenestrations, to include overhead doors, patio doors, access panels, windows, and the like without departing from the spirit of the invention.

Figure 1:
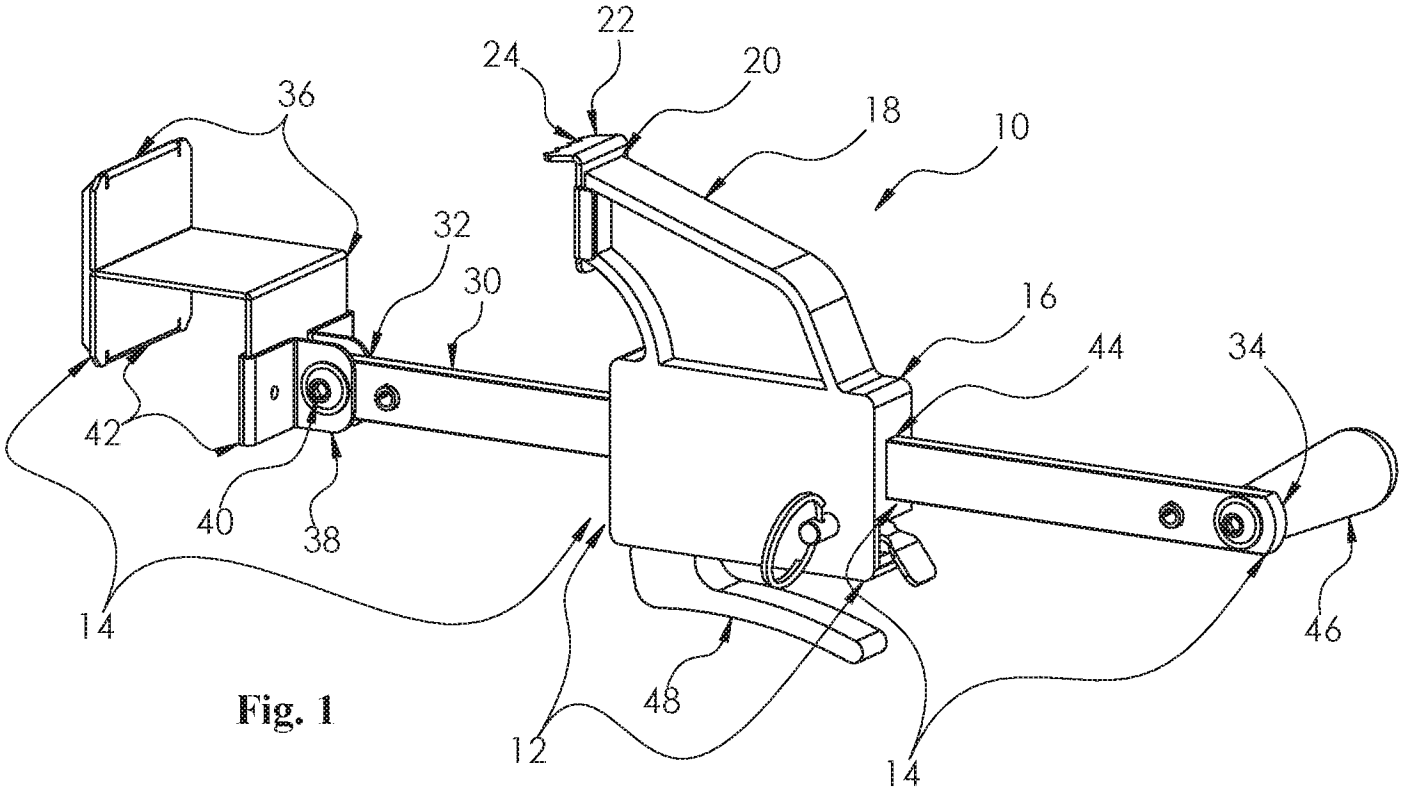
FIG. 1 shows an isometric view of an embodiment of the disclosed and claimed invention detached from a door.

Turning attention to FIG. 1, the barricade apparatus 10 includes a body portion 12 and a shaft portion 14. The body portion 12 includes a housing 16. The housing 16 may be fabricated from a variety of materials to achieve design objectives. By way of example not limitation, the housing 16 may be formed by injection-molded plastic, stamped sheet metal, machined billet, or other means known to one of ordinary skill in the art. The housing 16 is configured to retain internal components (to be described later) in a spatial relationship with each other. The housing 16 includes a pushing boss 18 that protrudes therefrom. The pushing boss 18 terminates in a pushing face 20. The pushing face 20, as will be explained in greater detail below, is configured to apply a force to a frame or wall adjacent to a door panel. The pushing face 20 may further include a retention plate 22. The retention plate 22 may include serrations 24. The retention pate 22 is configured to achieve enhanced purchase of the barricade 10 in cooperation with the mating door frame or wall surface.

The shaft portion 14 includes a shaft 30 having a first end 32 and a second end 34. The first end 32 terminates with a door bracket 36. The door bracket 36 is pivotably mated to the shaft 30. In some embodiments, the door bracket 36 is connected to the shaft 30 by means of a frictional engagement between door bracket ears 38 and the shaft 30. A fastener 40 applies the requisite force to the door bracket ears 38, thus imparting a frictional contact between the door bracket ears 38 and the shaft 30. In some embodiments, the fastener 40 is configured to apply a force such that the door bracket 36 may be repositioned with a user's hand pressure, yet the force is also sufficient to prevent movement of the door bracket 36 due to gravity or during transportation of the barricade 10. A purpose of the frictional engagement is to aid a user in aligning the door bracket 36 during installation thereof. In contrast, a freely pivoting door bracket 36 greatly increases the amount of time and effort that a user must expend to properly deploy the barricade 10. In other embodiments, the door bracket 36 is biased into a preconfigured angular relationship with respect to the shaft 30 by means of a clock spring, resilient member, or other biasing component known by one of ordinary skill in the art. In the other embodiments, limit screws or other blocking projections may be employed to set a desired minimum and maximum angle of the door bracket 36 with respect to the shaft 30. Other embodiments may include electrically driven, or other semi-automatic means of positioning the barricade 10 without user interaction. By way of example and not limitation, a servo, stepper motor, spring and retarding damper, etc., may be used. Those mechanisms could aid in both securing and egressing by pivoting the barricade 10 toward or away from a frame 82 (described in detail starting at FIG. 3). Likewise, those mechanisms can be employed to reciprocate the shaft 30 with respect to the housing 16 independent of user contact.

The door bracket 36 includes a throat 42 configured to receive the edge of a commercial or residential door slab. The throat 42 dimension may frequently range between 1⅜" to 1¾", the standard dimensions for a residential door thickness, and a commercial door thickness, respectively. The throat 42 of the door bracket 36 may be modified to cooperate with much thinner or thicker profiles of doors, but a throat depth of 1¾" provides a high degree of compatibility with respect to doors found in the United States. The fastener 40, may be readily removed in the field to facilitate replacement of the door bracket 36 with a different configuration suitable for cooperating with different door profiles or other geometries found outside of the United States, special purpose doors, or the like. In other embodiments, the fastener 40, depicted in FIG. 1 as a flange head hex screw, may be replaced with a quick detach mechanism to facilitate tool-less removal of the door bracket 36. By way of example and not limitation, the quick detach mechanism may include a wing nut and bolt, ball locking pin, cam acting lever, or the like.

As will be explained in greater detail with respect to FIG. 2, the shaft 30 may reciprocate with respect to the housing 16 by passing through ports 44. Under a default operating conditions, the shaft 30 may be moved freely in a first direction defined by the second end 34 displacing away from the housing 16 (or away from the body portion 12). The second end 34 may be manually translated away from the housing 16 by a user pulling on the shaft 30 by way of a handle 46. Alternatively, the shaft 30 may be incrementally moved in the first direction, wherein the second end 34 displaces away from the housing 16, by depressing the advancement lever 48. Each full depression of the advancement lever 48, drives the second end 34 of the shaft 30 a fixed incremental distance away from the housing 16. Similarly, each partial depression of the advancing lever 48, drives the second end 34 away from the housing 16 a distance proportional to the amount the advancing lever 48 is depressed. Under default operating conditions, the motion of the shaft is substantially unidirectional. The shaft 30 may not freely translate in a second direction defined by the second end 34 moving toward the housing 16 (or toward the body portion 12). The reference to "substantially" is intended to connote that there will be some measurable mechanical backlash in the system, but from a user's perspective, there may be no perceptible movement in the second direction. The advancing lever 48 may be substituted for a button, paddle, pull-string, gear, or electrically driven feature to meet design objectives. A substitute for the disclosed advancing lever 48 may be referred to as an advancing interface, generally.

A first alternative to the default operating condition includes a released condition. The released condition may be activated a release feature. I come embodiments, the release feature may be accessed by a user pressing a release tab 50. When the release tab 50 is held down by a user, the unidirectionality of the shaft 30 is disabled, and the second end 34 of the shaft 30 is free to travel both toward the housing 16 and away from the housing 16. In other words, bidirectional motion of the shaft 30 is enabled. While the shaft 30 is free to travel as described, in that any ratcheting action or unidirectional restriction is disabled, it will be understood that the movement will not be frictionless and some amount of detectable drag, stiction, or hesitation may be encountered by the user. In some embodiments, the releasee tab 50 is a momentary acting mechanism. The operation of the release tab 50 is only maintained for as long as a user applies force to the release tab 50. In other embodiments, the release tab 50 operates in a latching or toggle configuration, wherein a first press of the release tab 50 initiates the released condition, and a second press of the release tab 50 disables the released condition (returning the barricade 10 to the default condition). Further still, some embodiments will employ a first release feature (a tab 50 or other user interface) to activate the released condition, and a different user interface, to cancel the released condition (returning the barricade 10 to the default condition). It will be understood by one of ordinary skill in the art of that while the release feature is depicted as the release tab 50 (a thumb lever) in FIGS. 1-4, other user interfaces may be selected to provide desired results. A substitute for the release tab 50, may be referred to as a release interface, generally. In some embodiments, the release interface may be the same user interfaces as the advancing interface. By way of example and not limitation, a lever that is pushed to advance, and pulled to release; a shaft that is pivoted to advance and rotated to release; a knob that is pushed to advance and rotated to release; a button that is pulled to advanced and pushed to release, etc.

A second alternative to the default operating condition is the emergency release condition. The emergency release condition may be achieved by activating an emergency release feature. The emergency release feature is defined as being independent from the feature used to activate the released condition. In some embodiments, the emergency release feature is activated by pulling an emergency release pin 52 from the housing 16. When the emergency release pin 52 is removed from the housing 16, the shaft 30 is thereafter free to move bidirectionally with respect to the housing 16 in both the first direction and the second direction. The mechanism related to the emergency release pin 52 will be explored in greater detail with respect to FIG. 2. The emergency release pin 52 may be attached to a flag, handle, or other extension that allows for removal without the use of fine motor skills. It is noted that the emergency release pin 52 may be easily withdrawn from the housing 16 by children, the elderly, the differently-abled, or others who may have difficulty manipulating a device to obtain rapid egress. The barricade 10 will remain in an emergency release condition for as long as the emergency release pin 52 is absent from the housing 16. In other embodiments, the emergency release feature may be activated by a user breaking a glass component, turning a knob, striking a frangible component with another object, or the like. As was noted with respect to the released condition, above, when the emergency release condition is activated, it will be understood that the movement will not be frictionless and some amount of detectable drag, stiction, or hesitation may be encountered by the user.

Figure 2:
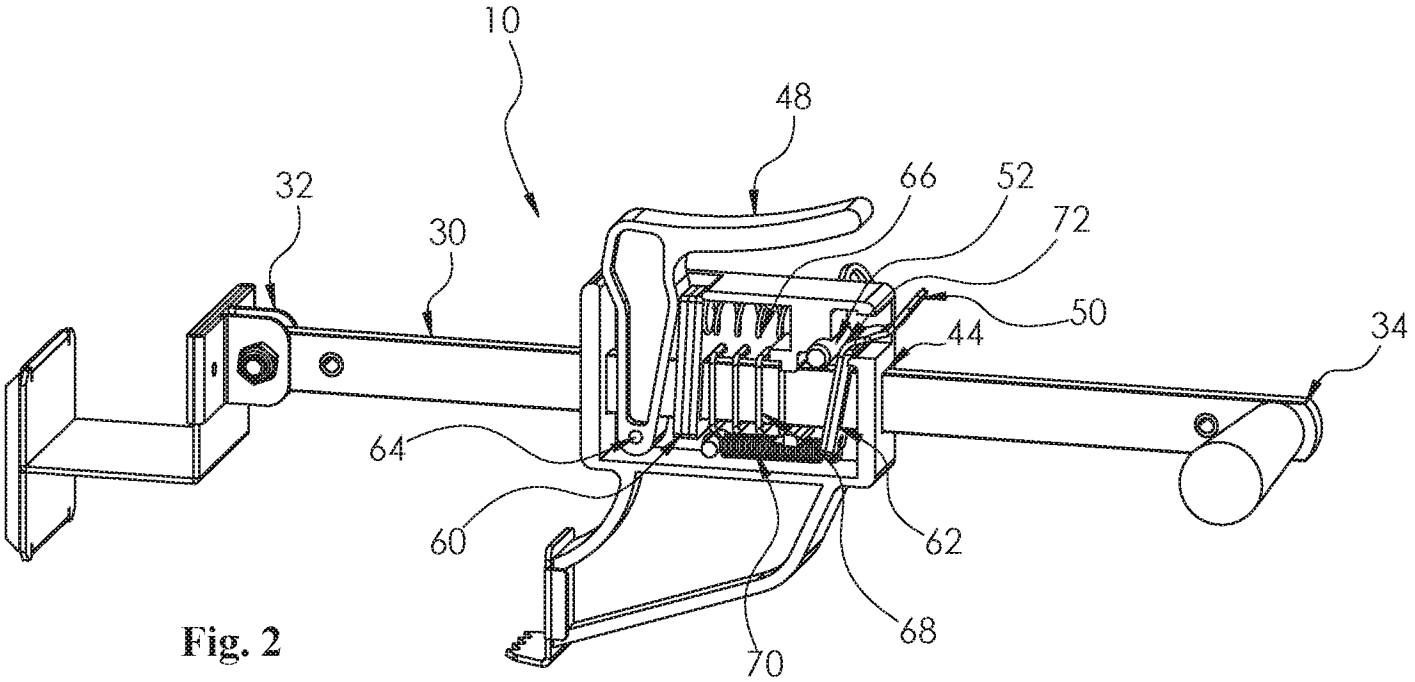
FIG. 2 is a partial cut-away view of an embodiment of the disclosed and claimed inventions.

Turning attention to FIG. 2, a partial cut-away view of the barricade 10 is shown. The shaft 30 passes through ports 44 of the housing 16, and further passes through drive plates 60 and stop plates 62. When the advancing lever 48 is pressed, it rotates about the pivot 64, thus contacting and displacing the drive plates 60. A first spring 66 and a second spring 68 cause the drive plates 60 to cant with respect to the shaft 30. This canting action causes the edges of the drive plates 60 to dig into the shaft 30, and continued displacement of the drive plates 60 thereby move the shaft 30 the same distance (less backlash or other mechanical slop). When the advancing lever 48 is released, the first spring 66 and second spring 68 allow the drive plates 60 to recover from their canted angle. This releases the drive plates' 60 grip on the shaft 30, and the drive plates 60 return to their resting position in the default condition.

While the drive plates 60 are responsible for displacing the second end 34 in the first direction away from the housing 16, the stop plates 32 are responsible for preventing the second end 34 from displacing in the second direction toward the housing 16. The stop plates 62 enable the default unidirectional motion of the shaft 30. That unidirectional motion is in a direction wherein the second end 34 may freely move away from the housing 16 in the first direction, but not toward the housing 16 in the second direction, unless the release condition or emergency release condition is activated. The third spring 70 biases the stop plates 62 into a canted configuration with respect to the shaft 30. The stop plates 62 dig into the shaft 30, preventing motion of the second end 34 in the second direction towards the housing 16, unless the release tab 50 is pressed, or unless the emergency release pin 52 is removed from the housing. Pressing the release tab 50 overcomes the bias of the third spring 70, thus removing the cant from the stop plates 62, and thus decoupling the stop plates 62 from contact with the shaft 30. Likewise, removal of the emergency release pin 52 removes the fulcrum 72 that the stop plates rest upon. Such removal of the fulcrum 72 likewise disables the biasing action of the third spring 70, removes the cant from the stop plates 62, and decouples the stop plates 62 from the shaft 30.

The depicted stop plates 62 are shown interacting with the shaft 30 by the use of sharp edges on the stop plates 62 digging into a substantially smooth shaft 30. This arrangement offers a high degree of adjustability (as opposed to a configuration that makes use of discrete ratcheting teeth and a ratcheting pawl). In addition to enhanced adjustability, after advancing the shaft 30, there is very little backlash or rebounding of the mechanism after the advancing is completed. It is often desirable that the material comprising the stop plates 62 is harder than the material comprising the shaft 30. However, it will be apparent to one of ordinary skill in the art that a tooth-based ratcheting mechanism may be desirably substituted to achieve certain design objectives. By way of example, a coarse tooth ratchet and pawl may survive a greater force during a forcible entry attempt. Likewise, from a user interface perspective, the audible and tactile clicking of the ratchet may assure the user that the mechanism is working correctly.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

Figure 3:
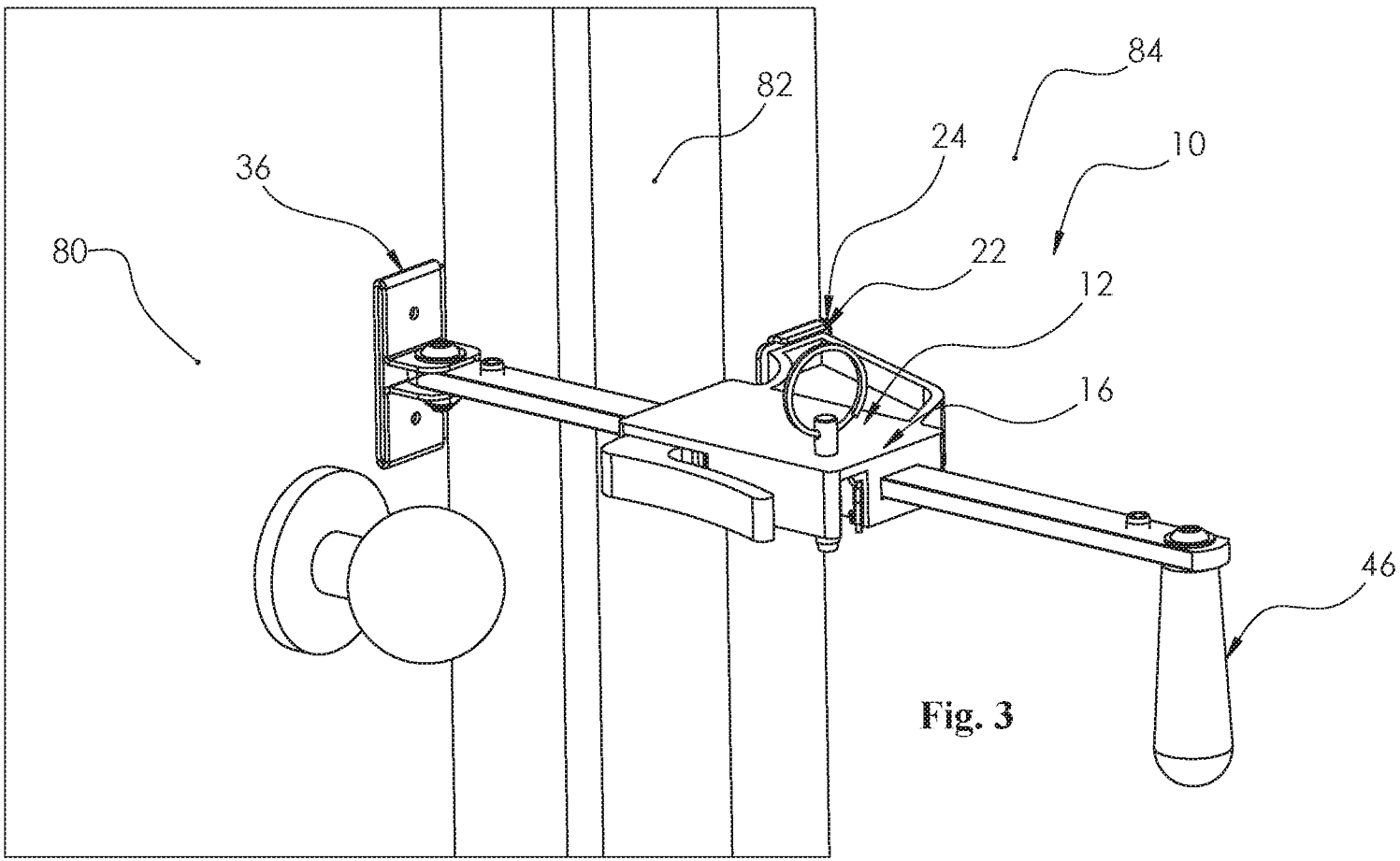
FIG. 3 shows an isometric view of an embodiment of the disclosed and claimed invention secured to a door and a frame.

Turning attention to FIG. 3, in use, the throat 42 of the door bracket 36 is slid over the edge of the door 80, and the door is closed against the frame 82. Owing to the pivotably coupled door bracket 36 and shaft 30, the barricade 10 is configured to avoid striking the frame 82 during the closing process. Once the door 80 is fully closed, the body portion 12 and shaft 30 may be pivoted up against the frame 82. A user holds the body portion 12 in one hand, and pulls the handle 46 and connected shaft 30 away from the body portion 12 and toward the user. This presses the retention plate 22 up against the frame 82. The optional serrations 24 may enhance the purchase of the barricade 10 by grasping the edge of the frame 82, or by digging into the wall 84. In this configuration, the door cannot be opened, inasmuch as the door bracket 36 is trapped between the door 80 and frame 82, and attempts to open the door cause such motion to be blocked by the interface between the retention plate 22 and frame 82. To further enhance security, a user may press the advancing lever 48 one or more times to advance the body portion 12 towards the door 80 and frame 82. This removes most play or mechanical slop in the various contact points between the barricade 10, door 80, and frame 82.

To remove the barricade 10, a user may press the release tab 50 (thereby disabling the action of the stop plates 62 (shown in FIG. 2), allowing the body portion 12 to be freely slid toward the handle 46 and second end 34 in the second direction. Once the housing 16, pushing boss 18, and retention plate 22 are clear of the frame 82, the body portion 12 may be pivoted out of the way of the frame 82, and the door 80 may be opened. In the alternative, a user may simply pull out the emergency release pin 52 from the housing. This disables the action of the stop plates 62 (shown in FIG. 2), and the housing 16, pushing boss 18, and retention plate 22 may be slid away from the frame 82, pivoted away from the frame 82, and the door 80 will swing open.

It should be noted that the disclosed and claimed barricade 10 requires no modification to the door or frame prior to use. Therefore, one barricade 10 may be used to selectively secure any one of x doors in a facility. Other designs may require a permanently installed barricade to be pre-installed on each door that may need to be secured in the future.

Figure 4:
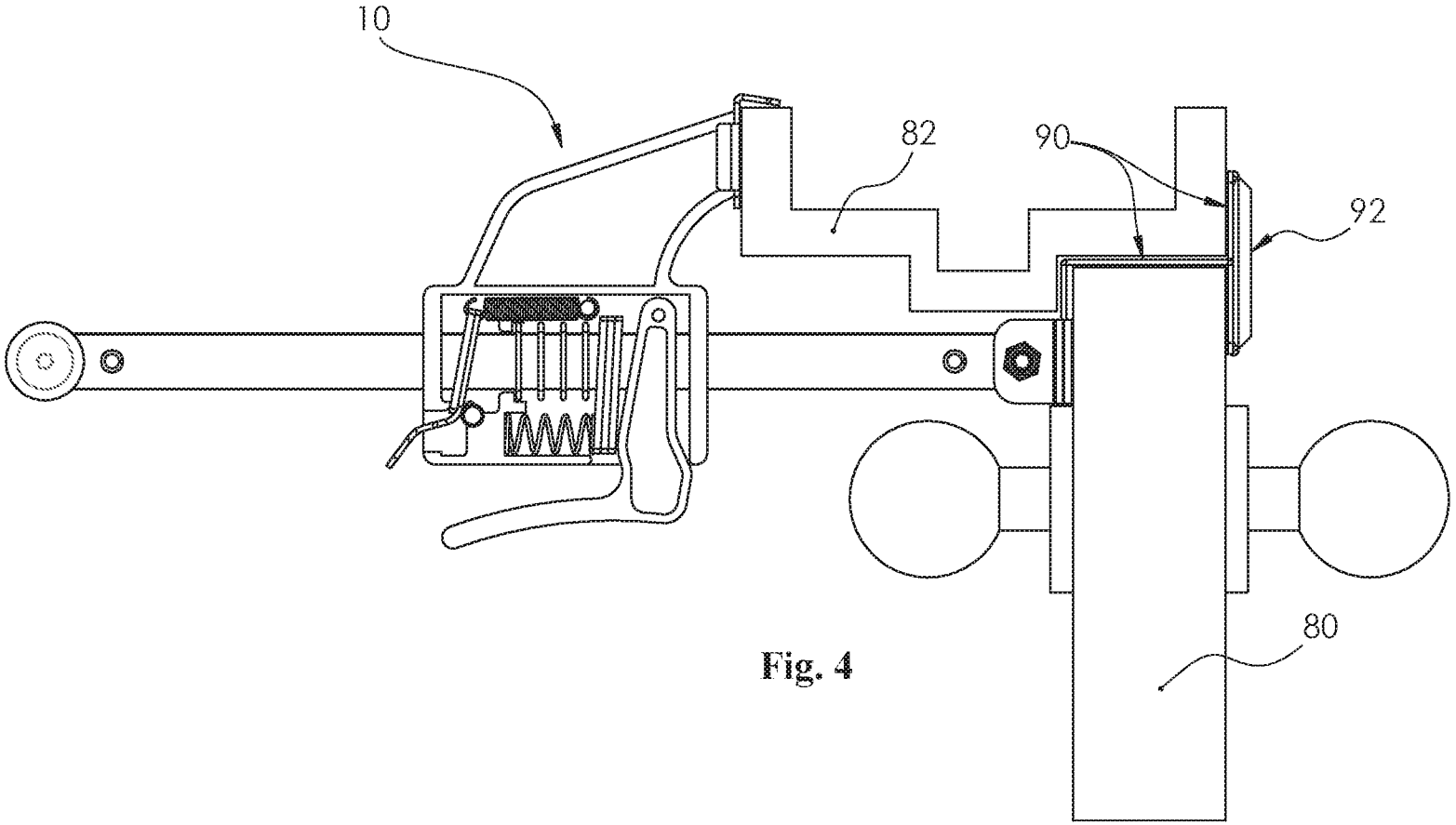
FIG. 4 is a top cut-away view of an embodiment of the disclosed and claimed invention that highlights the configuration of the door bracket.

When in place, the barricade 10 presents a very small attack vector to an assailant standing on the secure side. As shown in FIG. 4, the door bracket 36 presents itself as a small rectangle having about the same footprint as a doorknob. Further, the t-shaped configuration 90 provides enhanced resistance to forced entry. If an assailant works a prybar between the interface of the door bracket 36 and door 80, the opposing contact between the door bracket 36 and frame 80 resists attempts to bend the door bracket 36 away. Similarly, the configuration provides the same enhanced strength if a prybar is placed between the door bracket 36 and the frame 82. Further, ribs 92 offer enhanced bending resistance, while maintaining a very low profile. In some embodiments, the door bracket 36 is formed of folded sheet metal, and the folded sheet metal may be tempered for enhanced pry resistance.

Some embodiments may include an emergency bypass feature. The emergency bypass feature is in contrast to the emergency release pin 52 or other user interface that enabled the emergency release condition. The emergency release pin 52 allows a user on the occupied side to quickly release the barricade 10 to achieve egress. The emergency bypass feature is configured to allow first responders, school staff, or other authorized users to gain access to a door secured by the barricade 10. The emergency bypass feature does not require the interaction of a user on the occupied side, and in some embodiment may be activated without the consent of a user on the occupied side. In some embodiments, the emergency bypass feature is fully mechanical. A key cylinder, tamper-resistant fastener, or uniquely shaped receptacle is presented to the authorized user on the secured side. When the authorized user uses the correct key, tamper-resistant fastener driver, or tool that cooperates with the uniquely shaped receptacle, the door bracket 36 separates at the t-shaped configuration 90 or the door bracket 36 decouples from the shaft 30. Decoupling of the door bracket 36 at the t-shaped configuration 90 or from the shaft 30 allows immediate opening of the door. In other embodiments, an authorized user presents an electronic credential to the barricade 10 to achieve an emergency bypass. A servo or solenoid emulates a user pressing the release tab 50, or emulates activation of the emergency release pin 52, to disable the action of the stop plates 62 and obtain emergency bypass access. In some embodiments, the electronic credential may include a radio frequency signal, visible or invisible light, sonic or ultrasonic or haptic signal, that does not require contact with the barricade 10. In other embodiments, one or more contacts or terminals may be presented on the secure side of the door bracket 36. The authorized user may then present his credential to the barricade 10 by way of analog, serial digital, or parallel digital communication. In either the mechanical or electronic categories, the emergency bypass may be keyed alike, keyed differently, or master keyed. In the keyed alike configuration, each barricade has its own mechanical or electronic credential (notwithstanding the exhaustion of available credential permutations). In the keyed alike configuration, each barricade 10 in a given facility uses the same emergency bypass credential. In the master keyed configuration, a hierarchical set of credentials is used.

FIGS. 3-4 show the retention plate 22 in contact with a standard commercial metal door frame 82. The serrations 24 are configured to overlap the edge of the door frame 82, but do not dig into any surface. A standard door frame 82 has a face that is approximately 2" wide and 0.5" high above the wall 84 surface. Some environments may include frames 82 or additional ornamentation that differ from that standard configuration. By way of example, decorative wood or vinyl trim may be used to cover the metal frame 82. Under the vast majority of such circumstances, the serrations 24 effectively bite or dig into the surface or ornamental coverings of irregular or non-standard-dimensioned frames 82. However, if the retention plate 22 and serrations 24 do not sufficiently adapt to irregular door 80 and frame 82 configurations, a modified retention plate 22 may be substituted for an original retention plate 22. In some embodiments, a screw may be removed to exchange the retention plate 22. In other embodiments, a quick detach mechanism, to include a release button, a cam locking lever, or the like, may be used to permit substation of the retention plate 22 without necessitating tools. In some embodiments, a plurality of features may secure the retention plate 22. By way of example and not limitation, the retention plate 22 may slide onto the pushing face 20 by way of a cooperating dovetail or t-shaped track. The release button or cam lever then selectively enables or restricts the retention plate 22 from coupling or decoupling from the dovetail or t-shaped track. Some embodiments of the retention plate 22 include rubber or resilient coatings configured to enhance frictional engagement with the frame 82. Other embodiments of the retention plate 22 may be configured without serrations 24 and may include padded features to prevent cosmetic damage to the frame 82. Preventing cosmetic damage may be desirable when the barricade 10 is used as a training aid, or when frequent light-duty use of the barricade 10 is anticipated (e.g. barricading auxiliary doors each night to restrict building entry to a main door proximate a security or reception desk).

Figure 5:
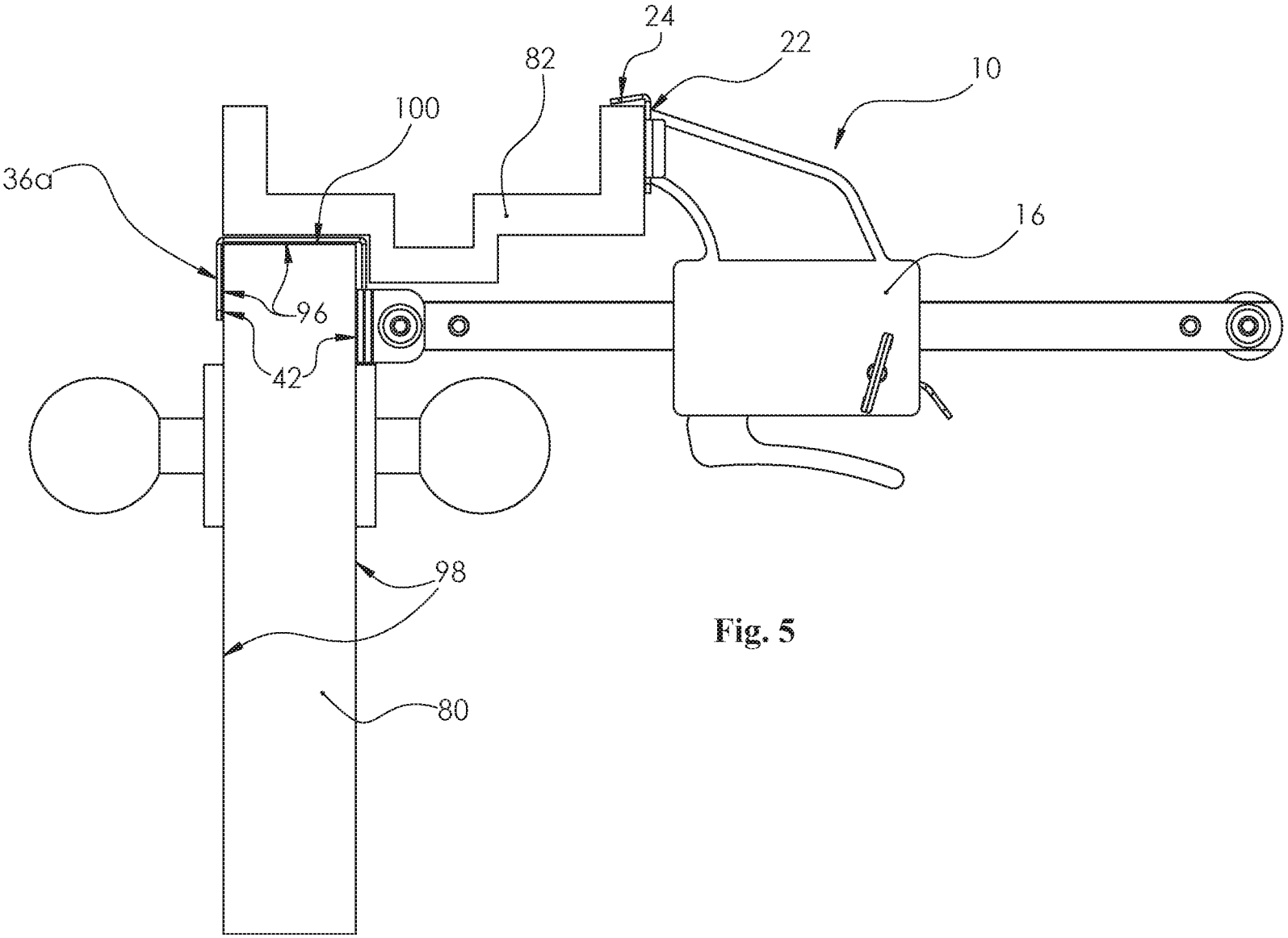
FIG. 5 is a top cut-away view of an embodiment of the disclosed and claimed invention depicting an alternate door bracket geometry.

While not a preferred embodiment, FIG. 5 shows the door bracket 36*a* in an alternate L-shaped configuration 96 (as contrasted with the T-shaped configuration 90 of door bracket 36 in FIGS. 1-4). The L-shaped configuration 96 provides effective mating with the door 80 as long as the throat 42 is dimensioned as disclosed above. The T-shaped configuration 90 door bracket 36 includes an additional flange to produce the T-shape. As such, an effective door bracket 36 must include at least an L-shaped configuration 96, but may include a T-shaped configuration 90. The nomenclature of a T-shaped configuration 90 or L-shaped configuration 96 describes the geometry facing the secure or attack side. The throat 42, included in both the T-shaped configuration 90, and the L-shaped configuration 96, defines the u-shaped profile that mates with faces 98 and edge 100 of the door. The throat 42 is formed by two substantially 90-degree bends, but may deviate slightly therefrom to achieve a friction-grip with the door faces 98 or to accommodate an edge 100 that may be beveled. As the T-shaped-configuration 90 or L-shaped configuration 96 comprise the distal end of the barricade 10, the throat 42 terminates in either at least the L-shaped-configuration 96, but may optionally terminate in the T-shaped configuration 90.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A door barricade apparatus, the apparatus comprising:

a body portion including pushing face, a port, an advancing interface, and a release interface;

a shaft portion including a shaft and a door bracket, the door bracket having a door edge engagement throat terminating in at least an L-shaped configuration, the throat having a door edge engagement dimension equivalent to a door thickness; and wherein the door bracket is pivotably coupled to the shaft at a first end and the shaft is disposed within the port, the door edge engagement throat of the door bracket having a proximal face attached to the first end of the shaft, a central face extending to the proximal face, and a distal face extending to the central face to form an L-shape, the proximal face and the distal face being parallel to each other and defining the door edge engagement dimension.

2. The apparatus of claim 1, wherein the throat terminates in a T-shaped configuration, wherein the distal face extends outward from its connection to the central face in two directions simultaneously, the proximal face and the distal face being parallel to each other and defining the door edge engagement dimension, wherein the central face and distal face form a T-shape.

3. The apparatus of claim 1, wherein the advancing interface is the release interface.

4. The apparatus of claim 1, further including an emergency release interface independent of the release interface.

5. A door barricade apparatus, the apparatus comprising:

a housing including a pushing face configured to contact a frame of a door or a wall proximate the door, a port, an advancing interface, and a release interface;

a shaft portion including a shaft and a door bracket configured to mate with an edge of a door, the door bracket having a door edge engagement throat terminating in at least an L-shaped configuration, the throat having a door edge engagement dimension the same as to a door thickness;

wherein the door bracket is pivotably coupled to the shaft at a first end, the shaft is disposed within the port, and the shaft terminates at a second end, the door edge engagement throat of the door bracket having a proximal face attached to the first end of the shaft, a central face extending to the proximal face, and a distal face extending to the central face to form an L-shape, the proximal face and the distal face being parallel to each other and defining the door edge engagement dimension;

wherein the housing is configured to allow the second end to be displaced in a first direction away from the housing and to prohibit the second end from being displaced in a second direction toward the housing in a default condition;

wherein the body portion housing is configured to allow the second end to be displaced in the first direction or the second direction in a released condition;

wherein activating the advancing interface displaces the second end in the first direction; and wherein activating the release interface activates the released condition.

6. The apparatus of claim 5, further including an emergency release interface configured to activate an emergency release condition independent from the release interface.

7. The apparatus of claim 5, wherein the advancing interface is the release interface.

8. The apparatus of claim 5, wherein the throat terminates in a T-shaped configuration, wherein the distal face extends outward from its connection to the central face in two directions simultaneously, the proximal face and the distal face being parallel to each other and defining the door edge engagement dimension, wherein the central face and distal face form a T-shape.

* * * * *